United States Patent [19]

Sekiya

[11] 4,435,970

[45] Mar. 13, 1984

[54] ROLL CHANGING DEVICE FOR ROLLING MILL

[75] Inventor: Teruo Sekiya, Takahagi, Japan

[73] Assignee: Hitachi, Ltd., Tokyo, Japan

[21] Appl. No.: 272,283

[22] Filed: Jun. 10, 1981

[30] Foreign Application Priority Data

Jun. 18, 1980 [JP] Japan ..... 55-81423

[51] Int. Cl.[3] ..... B21B 31/10

[52] U.S. Cl. ..... 72/239; 72/238

[58] Field of Search ..... 72/238, 239

[56] References Cited

U.S. PATENT DOCUMENTS

| | | | |
|---|---|---|---|
| 3,208,260 | 9/1965 | Sieger et al. | 72/239 |
| 3,376,724 | 4/1968 | Wolfendale et al. | 72/239 |
| 3,451,244 | 6/1969 | Stover et al. | 72/239 |
| 3,491,570 | 1/1970 | Beard | 72/239 |
| 3,842,639 | 10/1974 | Petros | 72/239 |

*Primary Examiner*—Lowell A. Larson

*Attorney, Agent, or Firm*—Thomas E. Beall, Jr.

[57] ABSTRACT

A roll changing device for rolling mills, in which the roll are changed through roll exchange between the work roll changing rails and intermediate roll changing rails which are mounted in a housing, and delivery rails placed in front of the rolling mill. The improvement comprises a vertically movable floor device carrying the delivery rails. The vertically movable floor device is adapted to move vertically to bring the delivery roll into alignment with the work roll changing rails and the intermediate roll changing rails to permit an easy and prompt roll change without any restriction in the space, even when the work rolls and the intermediate rolls are mounted at large depths from the floor level.

8 Claims, 5 Drawing Figures

ROLL CHANGING DEVICE FOR ROLLING MILL

BACKGROUND OF THE INVENTION

The present invention relates to a roll changing device of a rolling mill of the type having an intermediate roll disposed between a work roll and a back up roll.

Such a type of rolling mill has been known as having an axially displaceable intermediate roll between a work roll and a back up roll. In this type of rolling mill, the intermediate roll is axially shifted in accordance with the width of the material to be rolled to precisely control the deflection of the work roll over the entire length regardless of the change in the factors of rolling condition such as rolling load, rolling width and so forth. In consequence, the deflection of the work roll is diminished to achieve a high shape controlling performance.

The change of rolls in this type of rolling mill has been hitherto achieved by means of a complicated roll changing device having roll changing rails for respective rolls and mounted in a housing, and delivery rails disposed at the front side of the mill at the same level as respective roll changing rails and in alignment with the latter. The rolls are exchanged between the rails inside and outside the mill housing. The frequency or demand of the change of rolls is highest with the work rolls, while the back up rolls have lowest demand or frequency of changing. From this point of view, Japanese Patent Publication No. 7615/1979 discloses a roll changing device in which the delivery rails for at least the work rolls and the intermediate rolls are mounted on a roll changing truck adapted to run on stationary rails to permit change of two work rolls or four rolls including two intermediate rolls at a time.

The scale of the rolling mill of the type described is becoming huge year by year particularly in, for example, hot strip mills. In the large-size rolling mill of the kind described, the rolls and the roll changing rails are placed at a large depth from the floor level. In the conventional roll changing device of the kind disclosed in the above-mentioned Japanese Patent Publication, therefore, it is necessary to place the roll changing truck at a large constant depth within a pit in front of the mill. In consequence, the transfer of the new and old rolls to and from the roll changing truck becomes troublesome and difficult due to a restriction in the space. This in turn impractically prolongs the time required for the change of the work roll and the intermediate rolls which have to be changed at high frequency, resulting in a reduced yield of the rolled product.

SUMMARY OF THE INVENTION

Accordingly, an object of the invention is to provide a roll changing device for a rolling mill, which permits a rapid and easy roll change.

To this end, according to the invention, there is provided a roll changing device for rolling mills of the type having an upper and lower roll set constituting a pair, each including a work roll, an intermediate roll and a back up roll, said device having work roll changing rails and intermediate roll changing rails adapted for mounting said work rolls and said intermediate rolls during the roll change, said roll changing rails being disposed in a housing of said rolling mill, and delivery rails disposed in front of said rolling mill and adapted to deliver and receive said rolls to and from said roll changing rails, characterized by comprising a vertically movable floor device on which said delivery rails are mounted, said vertically movable floor device being movable to a position where said delivery rails align with said work roll changing rails and said intermediate roll changing rails.

In the roll changing device of the invention, therefore, it is possible to easily make the delivery rails align with the roll changing rails for the work rolls and intermediate rolls having high demand or frequency of roll change, even when these rolls are disposed at a large depth from the floor surface, to permit an easy transfer of the rolls into and out of the mill. In addition, the roll changing device of the invention permits an easy movement of the new and old rolls between the level of large depth in the pit and the level near the floor surface to afford the delivery of the new rolls onto the vertically movable floor device, as well as an easy discharge of the old rolls from the same, at the level of the floor surface. Accordingly, it is possible to effect the roll change of a plurality of rolls, however deeply they may be placed under the floor level, in quite an easy and rapid manner.

DESCRIPTION OF THE PREFERRED EMBODIMENTS

Figure 1:
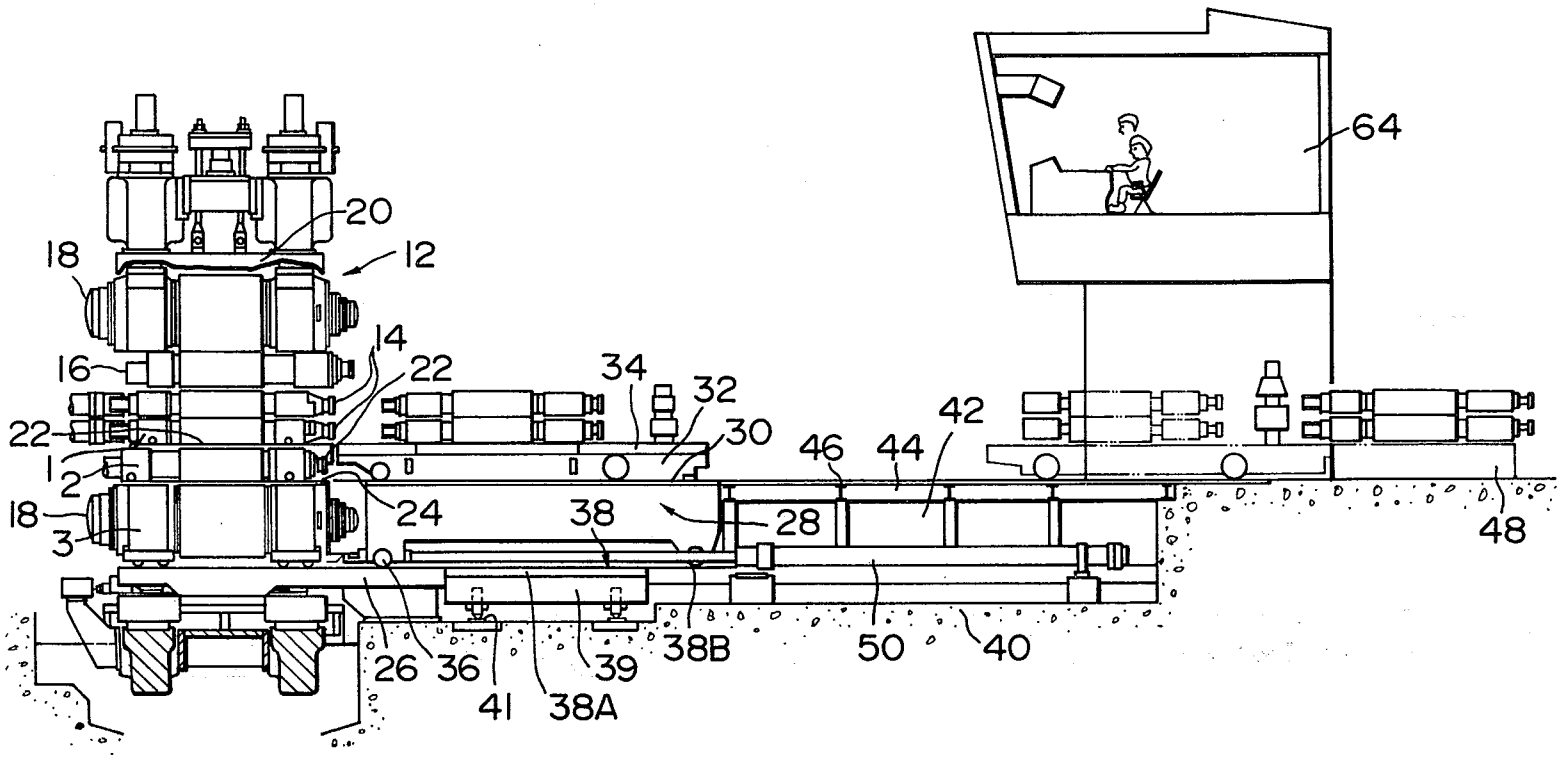
FIG. 1 is a partly sectioned side elevational view of the whole part of a roll changing device of the invention, in the state for changing the work roll.

Hereinafter, a description will be made as to a preferred embodiment of the invention applied to a rolling mill having 6 rolls.

This rolling mill 12 has a pair of work rolls 14, 14 between which the material is rolled, a pair of intermediate rolls 16,16 contacting the upper and lower sides of the upper and lower work rolls, and a pair of back up rolls 18, 18 contacting the upper and lower sides of the upper and lower intermediate rolls. Each work roll 14, intermediate roll 16 and back up roll 18 is provided at its both ends with metal chocks 1, 2, 3, respectively. More specifically, the metal chocks 1, 3 support the work rolls 14 and the back up rolls 18 such that these rolls are slidable vertically within the housing, while the metal chocks 2 carry each intermediate roll 16 in such a manner as to permit the latter to slide vertically and axially within the housing.

Wheels are attached to the lower sides of the metal chocks 1 for the lower work roll, metal chocks 2 for the lower intermediate roll and the metal chocks 3 for the lower back up roll. The housing accommodates work roll changing rails 22, intermediate roll changing rails 24 and back up roll changing rails 26. The arrangement is such that, during the changing of the roll, the wheels of the metal chocks fit and run on corresponding roll changing rails. As will be described later, the roll changing device of the present invention permits, when it is desired to change only the work rolls, the replacement of the old pair of rolls with a new pair of rolls may be accomplished at a time. Also, when it is desired to change the work rolls and the intermediate rolls or only the intermediate rolls, it is possible to change the old pairs or pair of rolls with new pairs or pair of rolls at one time. Similarly, the change of the back up rolls can be completed in pair.

A vertically movable floor device 28 is disposed in front of the rolling mill 12 (right side as viewed in FIG. 1). Rails 30 are disposed on the vertically movable floor device 28 so as to extend in the back and fourth directions. A roll changing truck 32 is adapted to move along the rails 30. The roll changing truck 32 carries rails 34 for pulling out the rolls.

The vertically movable floor device 28 has wheels 36 which are adapted to run on rails 38 extending in the back and forth direction and arranged at the same level as the roll changing rails 26 for the back up rolls. The rails 38 are constituted by a portion 38A mounted on the upper surface of the side shift frame 39 and a portion 38B fixedly mounted on the foundation 40 of the pit.

The side shift frame 39 is adapted to run on transverse rails 41, and is adapted to be used in the changing of the back up rolls 18,18.

At a predetermined distance from the front side of the rolling mill 12, i.e. across the vertically movable floor device 28, disposed is a stationary floor 44 of a predetermined height. A space 42 is preserved between the foundation 40 of the pit and the stationary floor 44. Rails 46 are mounted on the upper surface of the stationary floor so as to extend in the back and forth directions. The rails 46 extend to reach a roll table 48 in a roll shop or the like.

The vertically movable floor device 28 is adapted to be moved back and forth on the rails 38 by the power exerted by a hydraulic cylinder 50. More specifically, as the hydraulic cylinder 50 is actuated after moving the roll changing truck 32 to the stationary floor 44 and lowering the vertically movable floor device, the vertically movable floor device is stored in the space 42 beneath the stationary floor to provide the space for pulling out the back up rolls 18,18. (See FIG. 4)

Figure 5:
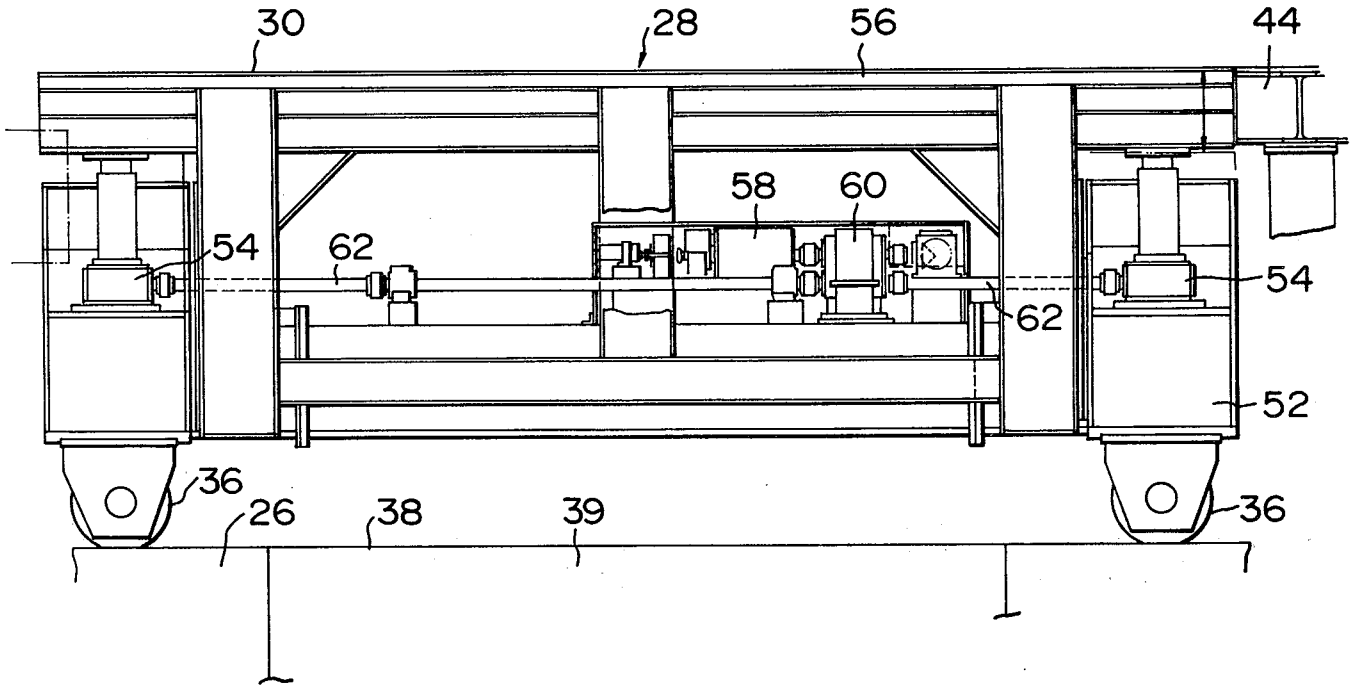
FIG. 5 is an enlarged view of the vertically movable floor device.

FIG. 5 shows the detail of the construction of the vertically movable floor device 28, particularly of the means for vertically driving the floor device.

Referring to FIG. 5, the vertically movable floor device 28 includes a movable column 52 having wheels 36 rolling on the rails 38 and a movable floor 56 vertically movably supported on the column through a worm jack 54. The aforementioned rails 30 are placed on the upper surface of this movable floor.

Figure 2:
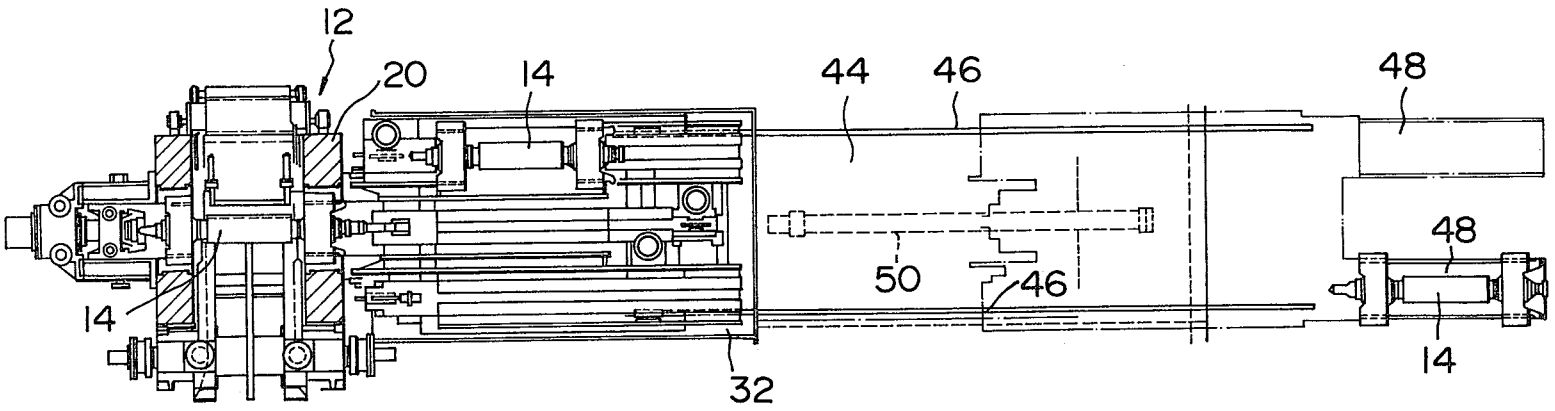
FIG. 2 is a plan view of the roll changing device shown in FIG. 1.

Usually, four worm jacks 54 are placed at right and left sides of front and rear ends of the movable column 52 (movable floor 56). The number of the worm jacks, however, can be increased or decreased as necessitated. The worm jacks 54 are adapted to be actuated through drive shafts 62 which constitute a transmission mechanism in combination with a speed reducing gear 60, by the power of a motor 58 mounted on the movable column 52 to change the height of the movable floor devices 28. FIG. 5 shows also the side shift frame 39 and the stationary floor 44 which are shown also in FIG. 2, as the associated parts.

Figure 3:
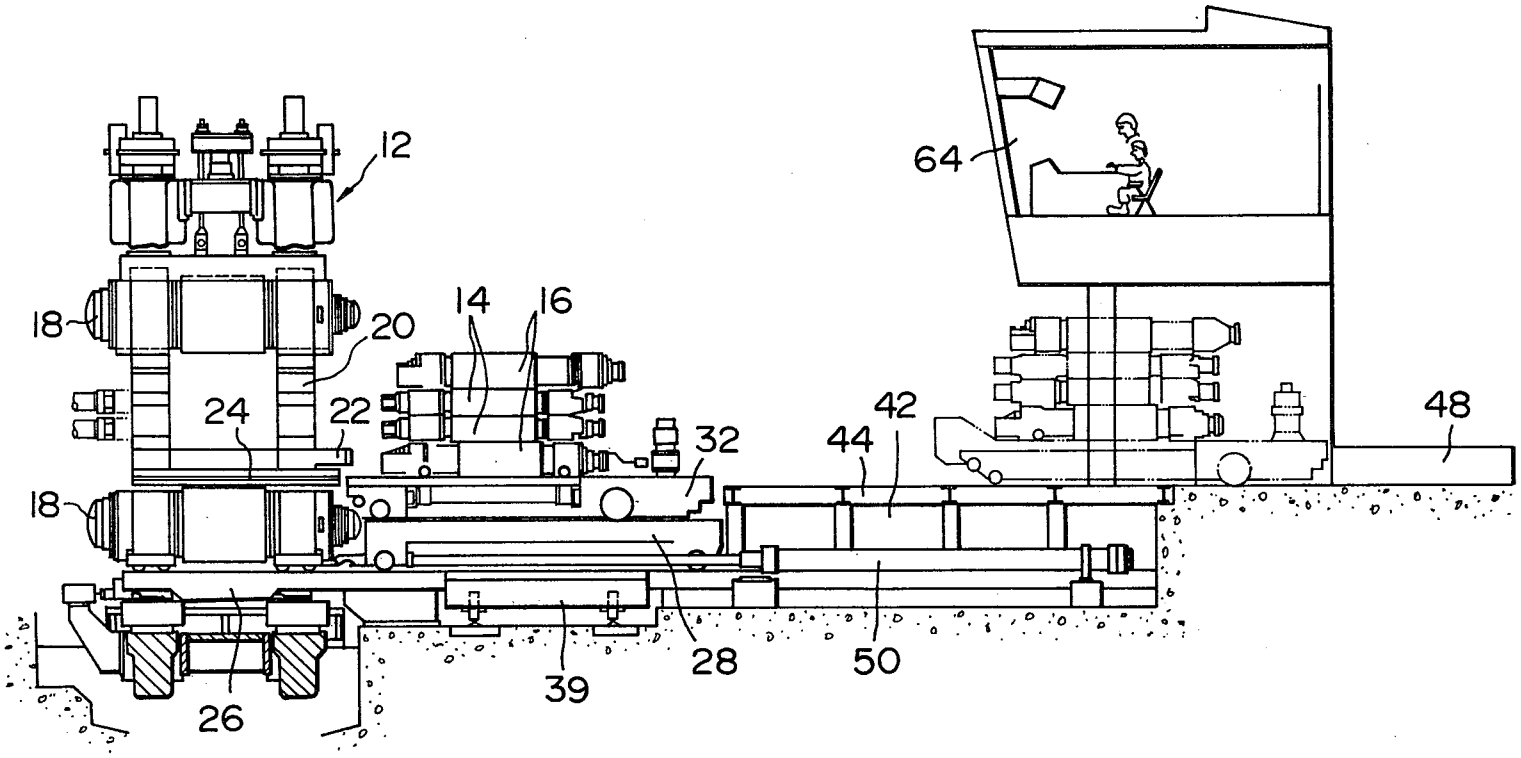
FIG. 3 is a partly sectioned side elevational view of the whole part of the roll changing device similar to that shown in FIG. 1, in the state of changing of the intermediate roll.
Figure 4:
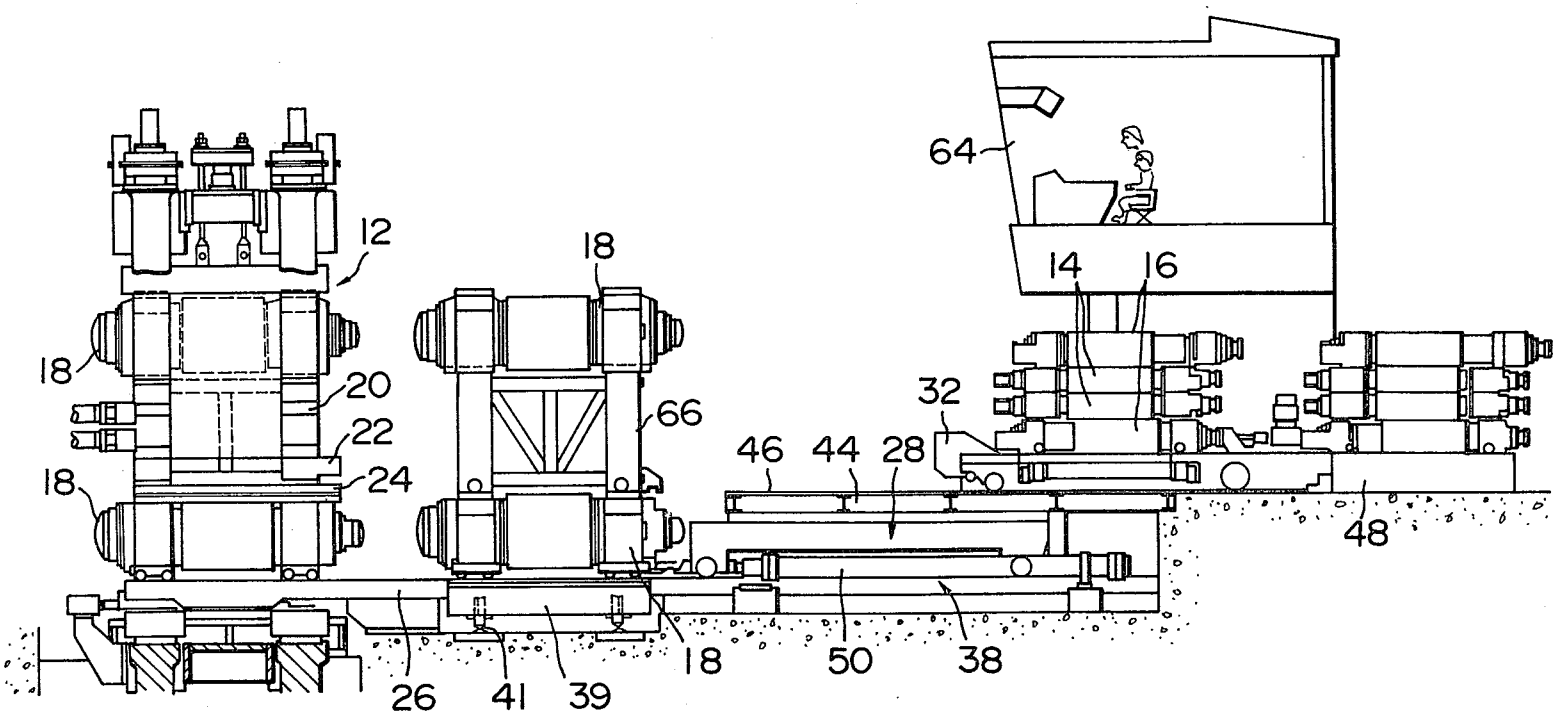
FIG. 4 is a partly sectioned side elevational view of the whole part of the roll changing device similar to that shown in FIG. 1, in the state of changing of the back up roll.

FIGS. 1, 3 and 4 show a control room 64. It is possible to remotely control various operations such as vertical and horizontal movement of the vertically movable floor device 28, operation of the roll changing truck 32 and operation of the side shift frame 39.

The roll changing truck 32 is a self-driving type truck adapted to take the intermediate roll into and out of the rolling mill 12, as well as into and out of the roll table 48.

The arrangement is such that, as shown in FIG. 4, when the vertically movable floor device 28 is moved back along the rails 38, the back up rolls 18,18 are pulled out to the rails 38 together with the movable column 52 of the vertically movable floor device.

The roll changing operation is made in a manner explained hereinunder.

The work for renewing the work rolls 14,14 will be explained first with reference to FIG. 1. As the first step of this work, the vertically movable floor device 28 is set so that its rails 30 are at the same level as the stationary floor 44. Then, the roll changing truck 32 carrying the new work rolls is made to run onto the vertically movable floor device 28 from roll table 48 and then the height of the movable floor device 28 is adjusted to bring the rails 34 of the roll changing truck 32 into alignment with the roll changing rails 22 for the work rolls 14, which results in the position shown in FIG. 1. The old work rolls are replaced with the new work rolls in this state, by any well known means for transferring a work roll unit between the roll change device of the present invention and the mill, and such means may be similar to that described in U.S. Pat. No. 3,208,260. Then, the reverse procedure is taken. Namely, the roll changing truck is moved back onto the rails 46 of the stationary floor 44, and the old work rolls are conveyed to the roll table 48. During the changing operation, suitable roll change pieces are interposed between the metal chocks of the upper and lower metal chocks to permit the mounting of the upper and lower work rolls as a set on the roll changing truck 32.

FIG. 3 illustrates the roll changing work in which the work rolls 14,14 and the intermediate rolls 16,16 are replaced with new ones simultaneously as explained below.

In this case, after setting the rolls 30 of the vertically movable floor device 28 at the same level as the stationary floor 44 (the position shown in FIG. 1), the roll changing truck 32 carrying new work rolls 14 and new intermediate rolls 16 is moved onto the vertically movable floor device 28. Subsequently, the vertically movable floor device 28 is lowered to the position in FIG. 3 to make the rails 34 of the roll changing truck 32 align with the roll changing rails 24 for the intermediate roll. The change of the work rolls 14,14 and the intermediate rolls 16,16 is conducted in this state, by any well known means for transferring a work roll unit between the roll change device of the present invention and the mill, and such means may be similar to that described in U.S. Pat. No. 3,208,260. Then, the reverse procedure is taken. Namely, the roll changing truck 32 mounting the old work rolls 14 and old intermediate rolls 16 is adjusted upwardly to the position of FIG. 1 and then moved back onto the stationary floor 44 where it is made to run to the roll table 48 to deliver the old rolls to the latter. It is possible to mount the work rolls and the intermediate rolls as a set on the roll mounting truck by placing suitable roll change pieces between the metal chocks.

FIG. 4 illustrates the roll changing work for changing the back up rolls 18,18. In this case, as the first step of the work, the same procedure as that explained in connection with FIG. 3 is taken to replace the work rolls 14, 14 and the intermediate rolls 16,16 with a spacer 66 for change of the back up rolls. The extracted work rolls and intermediate rolls need not always be conveyed to the roll table 48. Namely, it is possible to hold these extracted rolls on the roll changing truck stopping on the stationary floor 44.

In the change of the back up rolls 18, the work rolls 14 and the intermediate rolls 16 are extracted out of the mill stand housing 20 by the truck 32 with the floor device 28 lowered as the first step of this work. After raising the floor device 28, they are moved onto the stationary floor 44 by the roll changing truck 32 according to the procedure for changing the work and intermediate rolls as shown in FIG. 3. Then, the spacer 66, which has been prepared previously on the stationary floor is mounted on the truck 32 instead of the new work rolls and the new intermediate rolls after removing the extracted rolls. Then, the truck 32 carrying spacer 66 is moved to the position in front of the mill stand housing 20, the floor device 28 is lowered and the spacer 66 is installed in the mill stand housing 20 along the roll changing rails 24. Subsequently, the roll changing rails 24 are lowered to lay the spacer 66 upon the lower back up roll 18 and the upper back up roll 18 is lowered so as to be layed upon the spacer 66. Afterward, as shown in FIG. 4, the floor device 28 is attached to the chock 3 and moved away from mill stand housing 20 by contracting hydraulic cylinder 50 as the wheels of the chock 3 and wheels 36 of the floor device 28 travel on back up roll changing rails 26 and rails 38 to move the back up rolls 18 onto side shift frame 39. The side shift frame 39 is then shifted on transverse rails 41. Thereafter only the old back up rolls 18 with spacer 66 are conveyed to the roll shop or the like by traversing the side shift frame 39 along the rails 41.

Subsequently, the new back up rolls 18,18 with spacer 66 are moved to the position in front of the mill stand by means of the side shift frame 39. The new set is then pushed into the mill stand through the vertically movable floor device 28 forwardly by the action of the cylinder 50 to fit the new back up rolls 18,18 with spacer in the rolling mill 12 along the roll changing rails 26.

Then, the procedure explained in connection with FIG. 3 is taken to bring out the spacer 66 by raising the rails 24 to provide a clearance between the new lower back up roll 18 and the spacer 66 so as to make it easy to bring out the spacer 66, and then to fit the work rolls 14, 14 and the intermediate rolls 16,16.

When it is desired to change the work rolls and the intermediate rolls simultaneously with the change of the back up rolls, the spacer 66 for the back up roll is substituted by the new work and intermediate rolls.

As has been described, in the illustrated embodiment, the roll changing device has a vertically movable floor device positioned in front of the rolling mill, and the roll changing work is done by means of the roll changing truck mounted on the vertically movable floor device. It is, therefore, possible to easily extract the rolls to the outside of the mill even from a level deep from the floor level. The extracted roll is lifted to the level near the floor level where the work is easy to carry out and is then conveyed, if necessary, to a roll shop or the like. The same applies also to the mounting of new rolls. Thus, the roll changing device of the invention affords an easy and prompt roll changing operation even for large-sized rolling mill having rolls placed at a large depth from the floor level.

Furthermore, since the rails on the stationary floor can be aligned with the rails on the vertically movable floor device by the suitable operation of the latter, the level of the stationary floor can be selected freely without being restricted by the size of the mill and other factors. This permits such an arrangement to be taken that the stationary floor is positioned at the floor level and the rails on the stationary floor are extended to the roll shop on the same floor level. By so doing, it is possible to convey the work rolls or the set of work rolls and the intermediate rolls directly to the roll shop using the same rails on the stationary floor, without being assisted by any crane. This considerably increases the speed of the roll changing operation and, in addition, the safety of the work and the economy are also improved because the necessity for the long and deep pit between the mill and the work shop is conveniently eliminated. In addition, since the pit in front of the mill can be covered by the vertically movable floor device during the rolling operation, it is possible to achieve safety without requiring any specific floor plate which would cover the pit. Furthermore, the roll changing device of the invention makes it possible to change the rolls using the same roll changing truck even in such a rolling mill that the positions of the rolls are changed due to difference in the diameters of the rolls.

In the conventional roll changing device, it has been necessary to remove the floor plate in front of the rolling mill or to store the same in a stationary floor behind the rolling mill using a crane or the like means, resulting in a low efficiency of the roll changing work and long working time. It has also been necessary to lower the movable floor by a suitable means. According to the invention, it is remarkable that these troublesome works are all eliminated to ensure a higher efficiency of the work and shortened working time.

What is claimed is:

1. A roll changing device for rolling mills, comprising:

a mill stand having a housing, and upper and lower roll sets constituting a pair, each including a work roll, an intermediate roll and a back up roll with said intermediate roll disposed between said work roll and said back up roll;

work roll changing rails and intermediate roll changing rails spaced vertically from said work roll changing rails, respectively, and adapted for mounting said work rolls and said intermediate rolls during the roll change;

said roll changing rails being disposed in said housing;

a stationary floor being provided at the front side of said rolling mill at a fixed distance from said rolling mill and having rails mounted thereon;

delivery rails disposed between said rolling mill and said stationary floor, and adapted to deliver and receive said rolls to and from said roll changing rails;

a vertically movable floor device provided between said rolling mill and said stationary floor, said floor device having rails;

a roll changing truck carrying said delivery rails mounted thereon and movably mounted on said rails of said vertically movable floor device; said work and intermediate roll changing rails being common in size with and parallel to said delivery rails, and said rails on said stationary floor being common in size with and parallel to said floor device rails; and said vertically movable floor device being vertically movable respectively to a first position where said delivery rails on said roll changing truck join and align with said work roll changing rails, to a second position where said delivery rails join and align with said intermediate roll changing rails, and to a third position where said floor device rails join and align with said rails on said stationary floor.

2. A roll changing device as claimed in claim 1, wherein said stationary floor is positioned at the floor level and said rails on said stationary floor extend to a roll shop.

3. A roll changing device as claimed in claim 1, further including back up roll changing rails spaced vertically from said work roll and intermediate roll changing rails in said housing of said mill stand to change said back up rolls; additional rails movably mounting thereon said vertically movable floor device in the axial direction of said rolls and being of a size in common with and aligned with said back up roll changing rails.

4. A roll changing device as claimed in claim 3, further including means mounting said stationary floor to provide a chamber beneath said stationary floor; power means horizontally moving said vertically movable floor device on its rails in the axial direction of said rolls for moving said vertically movable floor device into said chamber beneath said stationary floor.

5. A roll changing device as claimed in claim 4, further including transverse rails between said stationary floor and said mill stand, extending transverse to the axial direction of said rolls, and being beneath said vertically movable floor device and said truck when they are in a vertically aligned position between said stationary floor and mill stand; and a side shift frame movably mounted on said transverse extending rails for movement to and from a position beneath said vertically movable floor device when said vertically movable floor device is between said mill stand and said stationary floor, said side shift frame carrying at least a part of said additional rails.

6. A roll changing device as claimed in claim 5, further including a rigid spacer means insertable between said back up rolls in said housing after removal of said working and intermediate rolls, to thereafter support the upper back up roll on the lower back up roll for removal of said back up rolls from said housing along said back up roll changing rails.

7. A roll changing device as claimed in claim 1, further including means for horizontally movably mounting said vertically movable floor device for retracting said vertically movable floor device in the axial direction of said rolls away from said roll stand in order to provide a space for permitting the extraction of said back up rolls.

8. A roll changing device as claimed in claim 1, further including means mounting said stationary floor to provide a chamber beneath said stationary floor; and means horizontally movably mounting said vertically movable floor device for movement thereof in the axial direction of said rolls for moving said vertically movable floor device into said chamber beneath said stationary floor.

* * * * *